US007018292B2

(12) United States Patent
Tracy et al.

(10) Patent No.: US 7,018,292 B2
(45) Date of Patent: Mar. 28, 2006

(54) METHODS AND SYSTEMS FOR METERED RAFFLE-STYLE GAMING

(75) Inventors: Joseph J. Tracy, Westminster, MD (US); Jason E. Bliss, Odenton, MD (US); Alvin R. Ringgold, Jr., Baltimore, MD (US); Mark G. Meyer, Zionsville, IN (US); Lee E. Cannon, Bozeman, MT (US)

(73) Assignee: Scientific Games Royalty Corporation, Newark, DE (US)

( * ) Notice: Subject to any disclaimer, the term of this patent is extended or adjusted under 35 U.S.C. 154(b) by 0 days.

(21) Appl. No.: 10/619,812

(22) Filed: Jul. 15, 2003

(65) Prior Publication Data

US 2004/0014515 A1 Jan. 22, 2004

Related U.S. Application Data

(63) Continuation of application No. 09/866,389, filed on May 25, 2001, now abandoned.

(51) Int. Cl.
*A63F 9/24* (2006.01)

(52) U.S. Cl. ..... 463/17; 273/269

(58) Field of Classification Search ..... 463/16–22, 463/40–42; 273/138.1, 139, 138.2, 143 R, 273/269

See application file for complete search history.

(56) References Cited

U.S. PATENT DOCUMENTS 4,191,376 A 3/1980 Goldman et al. ..... 273/139
4,206,920 A 6/1980 Weatherford et al.
4,494,197 A 1/1985 Troy et al.
4,665,502 A 5/1987 Kreisner
4,689,742 A 8/1987 Troy et al.
4,817,951 A 4/1989 Crouch et al.
4,922,522 A 5/1990 Scanlon
4,996,705 A 2/1991 Entenmann et al.
5,112,050 A 5/1992 Koza et al.
5,119,295 A 6/1992 Kapur
5,282,620 A 2/1994 Keesee
5,344,144 A 9/1994 Canon
5,536,016 A 7/1996 Thompson
5,564,700 A 10/1996 Celona
5,816,920 A 10/1998 Hanai
5,830,067 A 11/1998 Graves et al. ..... 463/40
5,871,398 A 2/1999 Schneier et al.
5,885,158 A 3/1999 Torango et al.
5,970,143 A 10/1999 Schneier et al. ..... 463/29
6,146,272 A 11/2000 Walker et al.
6,168,521 B1 1/2001 Luciano et al.
6,203,430 B1 3/2001 Walker et al.
6,210,275 B1 4/2001 Olsen
6,220,961 B1 4/2001 Keane et al.

OTHER PUBLICATIONS

Judith Gaines, Pool party Betting business booming throughout area workplaces, (Mar. 19, 1994).

*Primary Examiner*—Mark Sager
(74) *Attorney, Agent, or Firm*—Carlton Fields, P.A.

(57) ABSTRACT

Methods and systems for metered, raffle-style gaming implemented over a distributed network of locations and suitable for use in lottery and casino gaming environments. Potential winning numbers are issued in an order determined by relative time of a request for a number as received by a central controller, in comparison to the timing of other requests received by the controller, and matched to one or more known or predictable winning numbers. Time entries placed by players and compared to one or more target times may also be used to determine winning outcomes.

68 Claims, 4 Drawing Sheets

Sample Raffle Ticket

Sample Winning Raffle Ticket

METHODS AND SYSTEMS FOR METERED RAFFLE-STYLE GAMING

This application is application is a continuation of U.S. Ser. No. 09/866,389, filed May 25, 2001, which is abandoned, and incorporated herein by reference in its entirety.

BACKGROUND OF THE INVENTION

1. Field of the Invention

The present invention relates to games of chance and, more particularly, to methods and systems for metered, raffle-style gaming implemented over a distributed network of locations and suitable for use in several gaming environments, including without limitation lottery and casino gaming environments.

2. State of the Art

Casino gaming and lotteries have proliferated in recent years. As the number of casinos and other gaming outlets has increased, competition to attract customers has also increased. As a consequence, not only has there been a need for gaming operators to attract new customers, the need to retain old customers has become more compelling. Customer retention becomes increasingly difficult as games, even ones that have been successful at one time, become well played and cease to provide entertainment for players. As a result, there is a continuing need for participants in the gaming industry to develop new games that are exciting and entertaining. Games that retain their excitement and entertainment value, even after being played many times, are particularly sought after.

The current generation of casino gaming machines typically involves the generation of a random or quasi-random, outcome which is matched against preselected potential winning combinations to determine if the player has won. These games are represented by conventional gaming machines, also termed "slot" machines.

Many new games have been developed in the last few years to try to meet casino demand. Most of these games, however, are variations on conventional casino gaming machines involving. minimal player participation the player in the outcome of the gaming event.

A number of different techniques have been attempted to increase player interest in conventional gaming machines. Among these techniques has been a proliferation of games which add a bonus game to a base or primary game of a gaming machine. However, even with a bonus game, the player only provides some minimal physical input, (such as pushing a button, pulling a lever, or touching a touch screen) to start the gaming machine's random selection of the bonus multiplier. Efforts to increase player interest have also involved theming games to popular television shows, movies, and celebrities to attract customers.

Bonus games and the theme enhancements still rely upon conventional gaming machines and determine a player's game outcome completely independent of player action. Once the novelty of one of these gaming machines incorporating a bonus game or theme is exhausted, its popularity and the success may end prematurely and the resulting lack of patronage forces such gaming machines off the casino floor at significant cost to the casino and in many instances, the provider of the gaming machine.

Another method to increase gaming interest includes the use of progressive games, which allow a number of players to contribute and compete for a common jackpot. The success of progressive jackpot gaming lies in its ability to accumulate a substantial monetary jackpot. Games that provide large payouts, even if they are seldom hit, are highly desired by many players.

Progressive gaming systems typically are configured as individual gaming terminals connected to a central controller. All of the players on the networked terminals contributing toward the jackpot as they play. Progressive pools are maintained and accumulated as associated wager information is received. The substantial jackpots that are accumulated become very attractive and strongly motivate people to continue to play the game. Again, however, conventional gaming machine requiring no player skill are used to qualify a player for the progressive jackpot. Consequently and despite the progressive prize, these types of games still may become mundane as they require no significant input from the player.

Lottery gaming has become very popular with a large segment of the population of the various jurisdictions in which it is offered. Some lottery games involve purchase of a ticket at, for example, a retail outlet such as a convenience store, the ticket providing potential for a winning result in a periodic drawing. Other lottery games provide so-called "instant" wins for the purchaser, who knows immediately upon purchase of a ticket if a winning result has been achieved.

Few games of chance are attractive for implementation in a casino environment as well as in a lottery environment. Fewer still provide continuing, perceptibly "predictable" periodic awards occurring on a frequent basis and which may include substantial monetary awards if a multi-tiered game architecture is selected. In addition, there is a notable void in the gaming art with respect to games wherein timing of a player's wager provides an element of perceived skill in the game.

BRIEF SUMMARY OF THE INVENTION

The present invention includes a method and system for raffle-style gaming suitable for implementation over a distributed network of locations. In one embodiment, players may participate in a continuous, automated on-line raffle wherein potential winning numbers are awarded in the sequential order of request and matched in substantially real time against a selected winning number.

In one embodiment, players' wagers are associated with in the form of requests for one or more numbers in a series of numbers, one or more of which in the series is a winning number known to the players. Numbers are issued to the players in metered fashion responsive to the requests substantially in the time order of the requests, and each request results in the series incrementing to the next number therein. When an issued number matches a winning number, an award is paid. Either a single level or multiple tiers of raffle awards or multiple tiers of awards of varying magnitudes tied to relative frequency of occurrence of winning numbers for each associated award tier may be employed in the game architecture.

In another embodiment, the series of numbers comprises intervals in time, and the series of numbers automatically increments ahead regardless of player action. Players attempt to "hit" an exact match comprising a time entry matched to the time of placement thereof with one or more target times. If a target time is overshot or undershot by all of the players so that no exact match (within parameters set for the game) occurs, the wagers continue to accumulate in, for example, a progressive or pari-mutuel manner for a future payout when a match does occur. Near misses may result in awards, either in conjunction with an exact hit or independent thereof.

A variation of the immediately preceding embodiments includes incrementing a number count by a combination of passage of time and player action in the form of wagers comprising requests for numbers. Other arrangements of input from multiple sources to increment a meter are contemplated as encompassed by the present invention.

In all of the embodiments of the invention, prior knowledge of a winning value in the form of a number in a series or a moment in time and a player's ability to wager in a timed fashion provides an element of perceived player skill. In an embodiment where winning numbers occur in a series of numbers, each of which will (as opposed to may) be drawn by some player, the certainty of the winning outcomes is attractive.

The game of the present invention may be implemented on a distributed network including a central processor connected to a large plurality of remote game terminals, such as in a casino or lottery gaming environment. As noted above, the game is a raffle type game wherein players are rewarded based on a potential winning number (or time match) issued in accordance with a position in time with respect to a predictable winning number (or winning time) rather than choosing numbers to be matched against a randomly selected winning number.

In implementation of the present invention, it may be desirable to characterize tickets evidencing players' wagers with a time stamp indicative of the time the wager was made for security purposes, the amount of the wager placed, the winning number and the number provided to the player.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
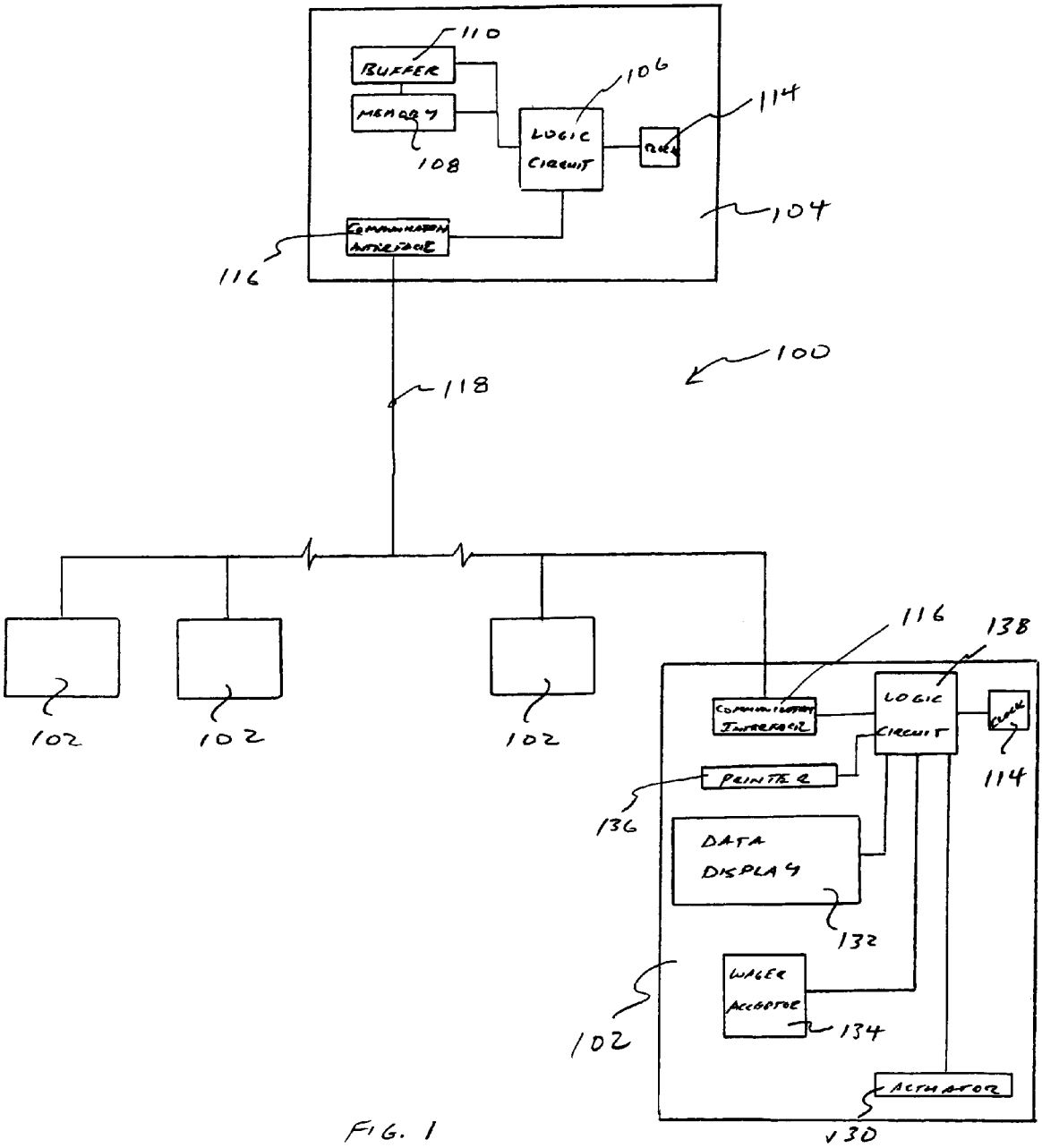
FIG. 1 is a schematic of a system including an exemplary central controller linked to a plurality of game terminals for implementing networked gaming according to the present invention, the components of one of which game terminals is depicted schematically.

The present invention includes a gaming method and system for use in casino, lottery and other gaming environments. The present invention may be implemented over a distributed network of retail outlet or other game terminals in communication with a central controller. The central controller is configured to communicate with the game terminals in substantially real time, to process incoming data from the game terminals and to output data to each of the terminals. Similar elements and features used in different portions of the system are identified with like reference numerals.

Each game terminal provides a player with an opportunity to place a wager, either directly as in a casino environment or indirectly through an attendant such as a retail clerk, as in most lottery environments.

In a first embodiment of the game of the present invention, the central controller is employed as a meter to issue a running number count which is incremented by a fixed number responsive to each wager made to procure a running count number in a series. The central controller matches running count numbers issued to players with one or more winning numbers in the series, which winning numbers may, and preferably do, occur on a periodic basis and are known to the players. Thus, the game provides "instant win" excitement for players in a manner which may be implemented easily over a traditional, existing lottery network.

In one embodiment, a single tier award structure of 50X, wherein X is the amount of a wager, is used. Tickets are issued to purchasers (players) at locations included in the distributed network with numbers issued in the time order in which each ticket is purchased. Every hundredth ($100^{th}$) number, network-wide, may produce a winner, for example a $50 winner for a $1 wager. The permitted wager may vary, for example, from $1 to $20 per ticket. Similarly, a plurality of numbers may be purchased per wager, either in consecutive order or randomly selected. A retail outlet (point of purchase raffle ticket vendor) bonus of, for example, $50, may be issued for every thousandth ($1000^{th}$) ticket sold per outlet when the game is offered in a lottery environment. Thus, the award payout from wagers on the game (not including retailer bonus), would be 50% in this embodiment. As used herein, the term "ticket" and "number" may be used synonymously when the game is implemented using a single number per ticket. Obviously, if a group of numbers is purchased as set forth in more detail below, the group of numbers may be printed on a single ticket or other tangible manifestation of a player's wager.

In a variation of the foregoing embodiment, a more dynamic, multi-tiered award structure may be employed. For example, in the instance of a $1 wager, every 100 number series may include a $10 winner, every 200 number series a $20 winner, every 1,000 number series a $100 winner, every 5,000 number series a $500 winner and every 500,000 number series a $50,000 winner. Again, the award payout would be 50% of wagers received. Another exemplary award structure (again, using a $1 wager) is every ten number series may include a $1 winner, every 100 number series a $10 winner, every 1000 number series a $100 winner, every 10,000 number series a $1,000 winner, every 100,000 number series a $10,000 winner and every 1,000,000 number series a $100,000 winner. Prior to the start of each number series spanning all of the award levels, the winning numbers are selected and made known to the players. Of course, other tiered award structures employing fixed awards to enable an exact and guaranteed payout ratio (and attendant game operator hold) may be easily calculated by one of ordinary skill in the art. It is specifically contemplated that, with a multi-tiered award structure wherein a winning number may qualify for multiple awards, alternative payout schemes may be used at the option of the game operator in setting up the award architecture. For example, when every hundredth number qualifies for a $1 award from the every ten number series as well as for a $10 award for every 100 number series as in the immediately preceding example, hitting the hundredth number may either result in both awards being paid ($11 per this example) or only the higher award ($10 per this example) for which the winning number is eligible.

Numbers may be rolled back to zero on the criteria of number of tickets sold (every 100,000, every 1,000,000, etc.), or by date (daily, weekly, monthly, etc.).

Each wager results in a request for a number communicated by the game terminal from which the wager is placed to the central controller, which issues a series of running count numbers in the order in which requests are received from game terminals of the distributed network. The issued running count number is unknown to the player until a ticket is issued and, optionally, the issued number may be displayed at the game terminal. The central controller maintains the running number count with certainty. For example, the running number count may increment by one each time a player requests a number. Alternatively, the running count numbers may be randomly issued within a given series of numbers. The number issued by the central controller and received by the player is the then-current running count number at the moment in time the player's request for a number responsive to the wager placed is recorded at the game terminal to be sent to the central controller.

The received number is compared by the central controller to the winning criterion (e.g., a specific number, or a number that meets certain specific requirements, such as each hundredth number) established by, or for, the game and made available to the players. If the received number matches the established winning game criteria, the player is awarded with a payoff. If the received number selected by the player does not match the winning criteria and other players have not matched the still-available winning criteria (i.e., any remaining unmatched winning numbers), the game does not automatically end. The player has the opportunity to make another wager, and again try to match the winning criteria.

In one implementation, players see their position in the "list" of numbers (for example, vis-a-vis the hundredth ticket) each time a ticket is sold. A player near the winning number is thus tempted to purchase another ticket immediately, while a player who determines he or she is a substantial distance from the winning number may be tempted to "time" a subsequent ticket purchase to try and hit the thousandth or ten thousandth, winning ticket. Of course, the existence of other, more frequently occurring winners, such as every hundredth ticket, provides an incentive to keep playing even between the larger awards. Displays to players and potential players at or near the point of purchase may be programmed to show a rolling total of the number of tickets sold, to stimulate interest and excitement. Over a distributed network including a large number of locations, sequential numbers associated with ticket purchases may accumulate so quickly that it would be virtually impossible to predict the timing of an event such as a hundred sale, particularly as each hundred number approaches and the rate of ticker purchasing accelerates based on a perceived improved chance of hitting a winning number.

This potential for further play of the same game enriches the game by allowing the player to obtain additional information about the progress of the game with each wager or, optionally, from a display associated with the game terminal. This information can be used by the player to help develop a strategy to determine when to time the next number selection. In addition to learning how far the game has progressed in relation to the winning criteria, the rate of change of the running number count can also be estimated. Through successive iterations of this process, the player obtains game information that may be useful in determining an optimum time frame in which the winning criteria may be potentially matched. For example, as the range between the last selected number and a winning number decreases, the player may then begin to play the game more rapidly or even continuously, or wager to request multiple numbers, either in a consecutive series or randomly. The requested and issued unknown number (i.e., the running count number for the wager), and the time the request was made for that number, may be shown to the player on a display screen of the game terminal.

One incentive for players of the game of the present invention in comparison, for example, to conventional casino games and random number lotteries is that the awards comprise guaranteed giveaways, in that for every (for example) one hundred tickets sold, there will a winner of, in an above example, of $50. Thus, the game creates anticipation and excitement superior to other "instant win" games. In addition, the award structure is self-funding from the tickets purchased for each number series tied to one or more awards, and requires no separate infrastructure, such as issuance of pay slips to be compared against a winning number generated in a subsequent drawing (with attendant promotion and added expense), enhancing profitability for the game operator. Due to the ability to implement multiple tiers of awards in the same series of ticket numbers, multiple "raffles" may be conducted simultaneously and players may tailor their play toward lower, more frequent awards or toward larger, less frequent awards offered in the same ticket series.

The game of the present invention may add competitive spirit to gaming machine-implemented gaming in a casino environment through the potential for perceived interaction between players by providing a perceived opportunity to "select" a running count number based on timing and to continuously select and update strategy based on game play of the other players on-line on the network. As the pace of the game increases each time a winning number is approached, each player may make increasingly rapid decisions to win the game. This mental activity adds to the excitement and the mental rush of the game.

In an embodiment implemented in a casino environment, another factor making this game fun to play may be the physical interaction between the game terminal and the player. A relatively large button may be used for a player input element or actuator. This button may be designed to take some degree of physical abuse to allow a player to exert repeated, significant force on the button without ill effects to either player or the terminal. As the speed of play increases and the tension emanating from the impeding win increases, the players may interact with the actuator on a much more rapid and forceful basis, thus providing a physical outlet for the excitement of the game and provides the player with another aspect for enjoying the game. Watching people play the game may also be entertaining because of this physical aspect.

Another factor that makes the game interesting is the ability to be in sight of other players, watching their reactions, their game speed, and to be able to further assess the game's speed of play to help determine when to make the next number selection. Large, graphic displays indicative of the approach of winning numbers and the current rate of play, visible to players in a bank of gaming machines configured as game terminals for play of the game of the present invention, may be used to further stimulate interest and participation.

Still another aspect of this game that may enhance its entertainment value is that it can be embellished to increase the excitement of the game. Instead of only playing for one winning goal at a time, as noted above the game may be augmented with multiple award tiers associated with different winning numbers. Alternately, rules based winning criteria may be displayed during game play. For example, such a rules based criterion might payout for hitting any number with a 7. Such awards may be offered randomly during play of the game, and be in force for a given period of time or within a given range or run of numbers. Rules based winning criterion provide a mental challenge to the player. Not only must the player interpret the rule, he must apply it to the current game situation, and make a decision as to whether to attempt to hit on one or more additional numbers in addition to the normal winning numbers in the series by placing more wagers. This adds considerable metal stress and excitement while a player tries to track and develop a strategy to win both aspects of the game and provides a dynamic, ever-evolving game play that engages the mind to continually engross and entertain the player.

To make the game more interesting and entertaining for the player, a data display associated with the game terminal (or a larger display) may be configured to provide not only the running count number issued response to a wager and the time of the request, but also statistical data associated with game play. For example, the game terminal may display the last ten running count numbers issued (either at that game terminal or throughout the network), the times at which those numbers were selected, the present time, the total number of locations on the network, the number of requests for running count numbers made on the system within a specified time frame, the awards available, etc. The data display may also present the winning criteria (such as winning numbers, which may be updated as each winning number is passed in the running number count) for the game and any additional associated games that are offered. Moreover, it is contemplated that a graphic display, such as a dial, of the present "location" of an issued running count number with respect to one or more target winning numbers on the dial.

The present invention provides mental stimulation by providing an opportunity to take positive action to obtain a desired winning number by wagering and thus requesting one or more at a selected point in time, rather than to sit idly by hoping that particular symbols or a to-be-drawn random winning number will be matched to a player-selected number. The present invention also adds mental stimulation by allowing the central controller's microprocessor to take into account lulls in the game activity. To add excitement during these lull periods and to stimulate player action, the microprocessor may be programmed to offer more lucrative games in the form of more frequent winning numbers to stimulate cash flow. For example, when total wagering rate (in terms of cash flow) or rate of wagers placed falls below a certain magnitude for a selected period of time, such as fifteen minutes, the overall payout ratio may be enhanced or a random "wild" winning number inserted in an upcoming range of numbers.

The present invention may include a centrally controlled distributed gaming network 100, as illustrated in FIG. 1. A plurality of game terminals 102 (components of one of which are shown schematically) are provided for wagering and gaming activity. As noted previously, game terminals 102 may comprise retail outlet terminals in a lottery gaming environment, gaming machines in a casino gaming environment or remote terminals such as personal computers accessing the network through an Internet connection. Each game terminal 102 is in communication with a central controller 104, which may comprise a host computer such as a suitably programmed personal computer. The central controller 104 monitors and responds to player-initiated gaming activity at the game terminals 102. The central controller also controls overall game play, including determining winning game criteria, recording wager activity and issuing running count numbers responsive thereto and accumulating and distributing wager pools, among other activities. Of course, the various functions of the overall distributed gaming network 100 may be differently allocated between central controller 104 and game terminals 102, and such variations are expressly contemplated as being encompassed by the scope of the present invention.

In the context of an embodiment where a series of numbers is incremented or metered responsive to each wager, a significant function of the central controller 104 is to provide a running number count as wagers are placed at the game terminals 102 and requests for running count numbers are received from the game terminals 104. The central controller 104 is programmed to issue each running count number responsive to a wager in the sequence or order requests for running count numbers or groups of running count numbers are placed at game terminals. In a very straightforward embodiment, the running number count function of the central controller 102 is conducted as a linear arithmetic function, adding an increment of 1 to the next previously issued running count number. Another embodiment may use any mathematical sequence or function to increment the counter. For example, the counter may be incremented by, for example, 3 or 5 each time a number request is received to make the running number count "move" perceptibly faster to players. Each time a player wagers and requests a number, the number count may increase. The issued running count number is shown to the player. This number can then be compared by the player to the known winning number or numbers to determine the deviation between the issued and winning number, if the two numbers do not match so that the player may decide when to try again and place another wager. Of course, the comparison to determine whether a number issued to a player is a winning number may be performed by either the central controller 104 or, alternatively, the game terminal 102 to which a running count number is issued.

The central controller 104 includes a logic circuit 106 (a central processing unit (CPU), microprocessor, microcontroller, etc.), a memory 108, and buffer memory 110. It is preferable that central controller 104 have at least dual logic circuits 106 running synchronously to minimize any potential for a crash during a game, or a failure to issue each number requested by a terminal. The central controller 104 may also have a timer or clock 114. These timers or clocks 114 may be used to mark the time at which certain transactions associated with the game occur, and it is currently preferred that a timer or clock 114 be incorporated in central controller 104 as well as in each game terminal 102 for synchronization purposes as is discussed in more detail below. Time may be kept off the clock of the polling signal if a polled serial link network protocol is employed.

The central controller 104 and the game terminals 102 are preferably in substantially continuous communication through the network to coordinate, monitor, and control the game play. Input and output data, to and from the game terminals 102 and the central controller 104 is processed through suitable, compatible communications interfaces 116 located in the central controller and in each of the game terminals. These communication interfaces 116 control and coordinate communication between the central controller 104 and the game terminals 102. The communication interfaces 116 are configured to send and receive information between the game terminals 102 and central controller 104 through a network communication link 118 comprising, for example, hard wired lines such as copper or fiber optic telephone cables, coaxial cables or other suitable data communication lines as known in the art. These hard wired lines and their corresponding interfaces may be used with terminal address information associated with other data (such as in packet type transmission protocol) to identify each game terminal 102 with which the central controller 104 is in communication. Any appropriate type of communication protocol such Ethernet or, as currently preferred, a polled serial link may be used to provide communication via communication link 118. A secure, broadband Internet communication system may be employed. Wireless communication may also be used to implement or augment the network. For example, wireless systems may provide greater flexibility in retrofitting pre-existing casino gaming machines with a game terminal capability for networked gaming according to the invention. Wireless systems may also be used to enable placement of wagers from portable, hand-held terminals available, for example, to guests at the pool or spa facilities of a casino property. It is also expressly contemplated that portable, hand-held terminals may comprise personal digital assistants (PDA's) or sophisticated cell phones including similar capabilities.

Each game terminal 102 may include a player or attendant input element or actuator 130, a data display 132, and a wager acceptor 134 as depicted in FIG. 1. The input element or actuator 130 may be configured as desired (button, touch pad, touch screen segment, pistol grip with trigger, joystick, etc.) and associated with suitable circuitry as known in the art to allow a player or attendant to select a moment in time in which to request a running count number from central controller 104. The data display 132 is configured to provide game information to the player such as criteria (winning numbers) for winning the game, the amount in the prize pool, game status, the number of networked locations or those currently active in wagering on the system, etc. The data display 132 may include a cathode ray tube (CRT), plasma screen, field emission display (FED), liquid crystal display (LCD) or a combination of different display types. The data display 132 may also include a printer 136, either in lieu of or in addition to a visual type display of the aforementioned types. Any suitable type of printer 136 may be employed for generating evidence of a match of a running count number to a winning number in the form of a physical hard (paper) copy or ticket and may also provide some or all of the same information as provided by data display 132. The wager acceptor 134 is configured for receiving and accepting a wager from a player or from an attendant on behalf of a player in a retail environment. The wager acceptor 134 is desirably configured to accept coins, paper currency, credit cards or debit cards, including not only bank cards but those debit cards which may be preloaded with a given amount of currency. The wager acceptor 134 may also be configured to accept any type of player identification card allowing a player to be identified for the purpose of debiting their account with a casino property of the wager. The wager acceptor 134 may also be configured as a payout device to cash out of a game in response to a win or when the player otherwise decides to leave the game terminal. In a lottery environment, the wager acceptor 134 may be only an input device used to record a wager placed with an attendant or clerk to enable a request for a number, and does not actually accept currency, a credit or debit card, etc.

Each game terminal 102 also may have a logic circuit 138 (a CPU, preferably configured as a microcontroller or microprocessor), which may preferably be of similar operational speed to that of the central controller 104. It is highly desirable that at least all logic circuits and some associated components including input element or actuator 130 of each game terminal 102 be of similar operational speed, so that such uniformity, in combination with an associated timer or clock 114 (see below) provides each terminal with the same input speed for requesting a number to ensure that no game terminal 102 is more advantageous to use than another. The logic circuit 138 is operably coupled to the other component devices of game terminal 102 and may be used to coordinate and control the component devices including the wager acceptor 134, the input element or actuator 130 and the data display 132, as well as communication with the central controller 104 via interface 116. Alternatively, the game terminal 102 may be configured as a "dumb" terminal having only an input element or actuator 130, data display 132 (which may comprise only a printer 136) and interface 116, all game functions being controlled and monitored through the central controller 104. It is anticipated that a game terminal 102 incorporating a logic circuit 138 will provide a superior gaming experience. For example, the more sophisticated game terminal 102 configuration affords a capability to provide more sophisticated communication and other security measures, such as better (more accurate) timing synchronized with the central controller 104 and other game terminals 102 on the network.

In one currently preferred embodiment, each of the game terminals 102 includes a timer or clock 114, preferably as part of the logic circuit 138, to provide accurate time data for the aforementioned time stamp associated with issuance of a running count number. For the purposes of the present invention, it is preferred that the timers or clocks 114 of all of the gaming terminals 102 be kept mutually synchronized and synchronized with the timer or clock 114 of central controller 104. Highly accurate independent timing devices may be used in each of game terminals 102 and in central controller 104 and maintained in synchronicity, for example, by receipt of timing signals from a government broadcast. However, it is preferable to use the logic circuit 106 of the central controller 104 in conjunction with a timer or clock 114 employed as a "master" clock and to synchronize the timer or clock 114 of each game terminal 102 therewith. Timing signals may be sent to each of the game terminals 102 periodically and preferably at the same instant through communication link 118 of the network to ensure that the game terminal clocks or timers 114 are consistent with the central controller's master clock. With such an arrangement, the actual time of a request for a number at a game terminal 102 made responsive to player or attendant input to input element or actuator 130 may be conveyed to central controller 104 in conjunction with the request and the network address of the game terminal 102, thus eliminating inconsistencies in signal travel time between game terminals due to differences in distance from central controller 104 and variations in signal speed over the various, sometimes widely varied types of communication lines used in communication link 116. In a less preferred embodiment, the central controller 104 simply receives a number request signal from a game terminal 102 and assigns a running count number to each game terminal 102 in the order the signals therefrom are received. This much more simplistic approach, however, is susceptible to varying time delays in transmission to central controller 104 of the number requests over communication links 118 from the various networked game terminals 102. Such transmission time delays, when the difference in the timing of number requests by various may be extremely small, perhaps measured in milliseconds or even microseconds, introduce uncertainties that may significantly detract from game play and be perceived as unfair by players as a factor over which they have no control.

Although the above description provides an exemplary methodology for implementing the present invention, it will be recognized and appreciated by those of ordinary skill in the art that any type of conventional gaming system having a central controller in communication with, and in control of any number of game terminals may be modified and adapted for implementation of the present invention. Such systems are described in U.S. Pat. Nos. 5,564,700, 5,816,920, 5,885,158, 6,168,521, 6,203,430, and 6,210,275, the disclosures of each of which patents in their entireties are hereby incorporated herein by reference. One exemplary, commercially available, centrally controlled gaming system presently employed in a lottery type gaming environment and adaptable to implementation of the present invention and which is based on an IBM RS/6000 server is the MASTERLINK™ Advanced Gaming System offered by Anchor Gaming of Las Vegas, Nev. through its AWI operating unit.

The gaming system described above allows a player to determine a moment in time in which he may elect to request that a potential winning number be issued from the central controller 104. Each time the player makes a wager by, for example, inserting currency in the wager acceptor 134, by debiting a credit meter associated therewith or otherwise, he is entitled to actuate the input element or actuator 130 to send his request for the assignment of an unknown, potentially winning number to the central controller 104. As noted previously, this unknown number is a progressively changing number that changes with predictability. Immediately after the input element or actuator is activated, the game terminal's logic circuit 138 records the moment in time reflective of when the input element or actuator 130 was actuated for creation of a time stamp associated with a record of the request for the number, sometimes termed a "request record" herein for simplicity, the request record being subsequently associated with the number issued by central controller 104 and transmitted back to the requesting game terminal 102, the request record and assigned number being printed out on a permanent record such as a paper ticket or other proof of the transaction for evidentiary purposes.

The request record may contain a variety of data fields and information. The request record generally contains at least a game terminal identifier such as a number and the time stamp. Additional information may also be included in the request record, such as the wager amount associated with the transmitted number request. The data record may also include security codes to secure the transmission of the request record data from the requesting game terminal 102 to the central controller 104.

Once a request record has been compiled by the logic circuit 138 of a game terminal, the request record is sent to the logic circuit 106 of the central controller 104 via communication link 118. The logic circuit 106 stores the request record in a buffer memory 110. The logic circuit 106 thus accumulates a temporary data base of request records for compiling and queuing with other request records received from the same and other game terminals 102. This is done to ensure that the next running count number is assigned or issued responsive to the request record closest in time to the next previous request record to which a running count number has already been assigned or issued. The logic circuit 106 examines the various request records for duplicate time stamps indicative that a request for a running count number was made at the exact same instant in time by two game terminals 102. The likelihood of such an occurrence may be greatly reduced by increasing time resolution through the use of timers or clocks which increment or parse time intervals at least in hundredths of a second or in milliseconds so that any measurable variation in number request times will avoid a tie. In a large network of game terminals, time may even be incremented in microseconds if necessary.

A number of different approaches are contemplated for incrementing a running number count employed in the present invention. For example and as described in more detail below, the running count number may be changed as a function of time. In a currently preferred embodiment, the running number count is incremented to the next higher number by one each time a player at any of the game terminals 102 activates the input element or actuator 130. For example, if ten players have each made a single wager, the running count number is 10 (assuming zero as a starting point). Similarly, if a single player makes 10 wagers in sequence and without any request for a number by another player intervening in time, the running count is again 10. Using a "queue" of the players' requests for numbers in time order the requests are placed helps to randomize the progress of the running count by speeding up and slowing down the assignment of numbers responsive to various player requests for numbers, making it impossible to use a mathematical algorithm to predict the timing of issuance of the winning number and thereby defeat the somewhat random (subject to some limited effect of request timing as skewed by requests of other players) outcome of the game.

To further randomize the game and provide variety for the players, the running number count may be conducted additively to increase the numbers over time or subtractively, to decrease the numbers over time. Consequently, the running number count may be operated as a "count down" clock to decrease from a large starting number such as one million (1,000,000) and decrease to some target number such as zero for a grand prize award, with additional awards made during the countdown at, for example, increments of one hundred, five hundred, one thousand, ten thousand and one hundred thousand rather than increasing from zero or a small starting number to some larger, target winning value. In another variation, as soon as a target winning number has been matched by a number issued to a player, a new target number may be selected by the central controller 104 that may be either greater or smaller then the last target number. A smaller target number would thus require decreasing the current running number count when the former winning number is matched. In addition, the running number count may be caused to reverse each time a winning number at one end of a range of numbers is hit, and the winning number range reduced so that, as the running number count cycles back and forth, winners become ever more frequent. Another and currently preferred approach is to, as previously suggested, select winning numbers on a repetitive basis, so that each hundredth number is a winner (i.e., 100, 200, 300, etc.), or that every 100, 200, 1000, 5,000 and 500,000 tickets are winners, with awards scaled to frequency of occurrence. The central controller 104 may be used to poll the game terminals 102 for times when input element or actuator 130 is activated, and may broadcast to all game terminals the current counter or number value. Central controller 104 may also be used to send out new target, winning numbers or values to the game terminals. When central controller 104 receives a signal from a game terminal 102, it may respond with the counter value at the time of activation of input element or actuator 130, or the time error between that time and the target win time. The central controller 104 will also process the win if the activation time matches the target time.

The only significant time that request records having duplicate time stamps are of significance to the players is if the request record results in the issuance of a winning number by central controller 104. One method to break such a tie in request timing is for central controller to be programmed to simply to randomly select one of the same-in-time requests for issuance of the winning number. Another, currently preferred award approach from a perception of fairness to the players is to split the jackpot among the winning players. Yet another approach is to pay out the entire amount of the award to each of the winning players as a bonus for simultaneously requesting the winning number. Paying out multiple jackpots based on multiple simultaneous requests for numbers is not particularly attractive because of its potential for adverse impact on the game's profitability, but the relative odds for such duplication may be minimized by high (e.g., microsecond) timing resolution. The second approach of dividing the jackpot among all the winners is unattractive to many players, as players are attracted to games that have the potential for large jackpots. Consequently, smaller "split" jackpots simply may be unattractive and make the game less fun to play.

If there are no duplicate time stamped request records received, the central controller 104 sends the request records, queued in order of their time stamp from the buffer memory 110 to the logic circuit 106 to assign a running count number to the request record. In one embodiment, the microprocessor of logic circuit 106 simply increments the last assigned running count number by one and assigns that number to the next-in-time request record.

Figure 2:
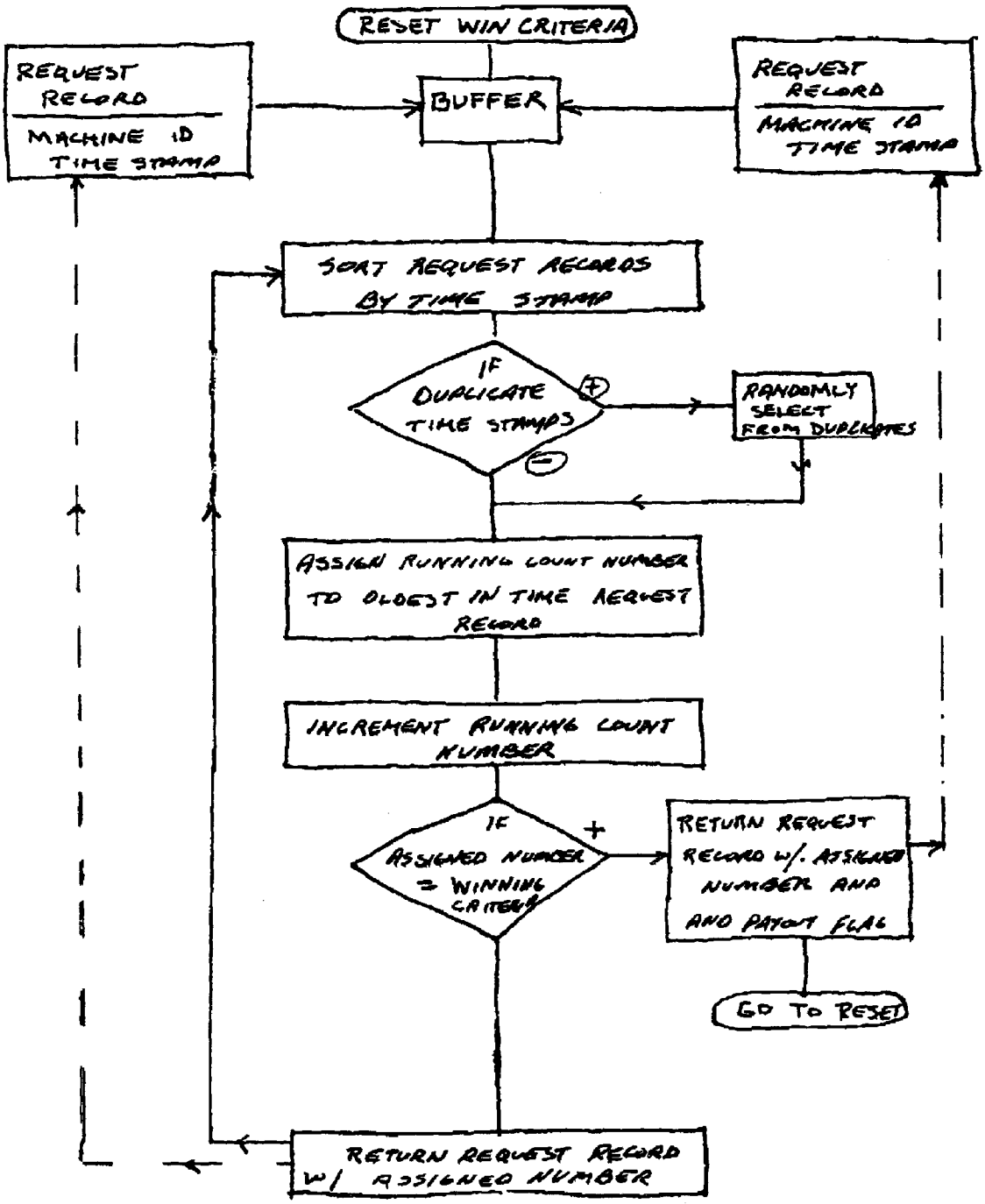
FIG. 2 is an exemplary flow diagram of a method of processing number requests and issuing numbers in the game according to one embodiment of the present invention.

The microprocessor then causes output of a response signal directed to the requesting game terminal 102 as identified by the request record. The response signal may simply be the request record re-transmitted and modified to contain the assigned running count number, the response signal thus contains the number assigned to the request record and the address of the game terminal 102, signified by its identifier. The response signal is received by the game terminal 102 and may be converted to a visual graphic for display on the game terminal's data display 132 and output in hard copy form on a ticket issued by printer 136 so that the player has at least a record of the wager, the time the number was requested and the running count number assigned. It is also desirable to provide the player with a record of the closest winning number or numbers even if his or her number does not constitute a winner, and the game terminal identifier. Although there are a number of sequential acts involved in request for, assignment of and display of a running count number in the course of gaming according to the present invention, it will be appreciated by those of ordinary skill in the art that the time between the activation of the input element or actuator 130 at a requesting game terminal and the subsequent display and/or printing of the assigned number at the requesting game terminal 102 is almost instantaneous and perceived to be so by the player. FIG. 2 represents an exemplary flow chart of the activities of central controller 104 in implementing one exemplary embodiment of gaming according to the present invention.

The response signal may contain more data than set forth above. The response signal may also contain statistical information that may be displayed on data display 132 and used to by the player in selecting the appropriate time to request another running count number. For example, the number of players on the networked game terminals 102 may be provided, or the time rate of change of the running number count may be displayed. Thus, the data display 132 may show the player's last five issued running count numbers (or the last five numbers from that game terminal), the times the numbers were picked, and the time rate of change of the numbers. The data display may also have a running clock to provide real time data to the player against which he or she can compare against the assigned numbers and their associated time request records. The response signal may also contain a more long term record of the timing of number assignments, variation thereof over the course of an hour, a day or even a longer period. Such information may be displayed numerically, graphically or both. In one embodiment, the data display may comprise a video countdown "clock" graphically depicting progress of the running number count toward one of more winning numbers. Of course, such information may be displayed constantly regardless of whether or not a player is making a wager. However, to add some suspense to the game and to provide a partial reward for playing the game, particularly in a casino environment, in one embodiment only currently active game terminals (such as, for example, terminals having been played within the last 15 seconds) may be rewarded with such information.

As discussed above, when input element or actuator 130 is activated, the. request signal is sent by a game terminal 102 to central controller 104, which typically returns to the terminal the value of the running number count at the time of the request indicated by the signal. Alternatively, the central controller 104 may return an error value indicative of how far the request missed a winning number. The central controller 104 may also determine if the issued running count number is a match for a winning number. One implementation of such a scheme may be to maintain a list in computer memory of the respective times associated with each increment of the number, retaining the last xxx milliseconds of data, where xxx is long enough to cover any communications delay.

In addition to providing a response signal to a specific game terminal 102, it is also contemplated as within the scope of the invention to provide information to all, or selected, (such as presently active) game terminals 102 as desired. For example, the game terminals may be signaled that a winner has been declared or that some bonus feature of the game has been temporarily activated.

The central controller 104 may also have the function of determining the winning numbers for the game, including supplemental winning numbers if such an approach is implemented. For example, the central processor 104 may be programmed to, if desired, initiate special bonus features of the game associated with supplemental winning numbers. These supplemental winning numbers may be selected by central controller 104 during a gaming sequence already in process or determined ahead of the game sequence initiation. Such supplemental winning numbers may be, for example, generated by central controller 104 either on a random basis, or may based in whole or in part on game play variables. The controller may use player data such as the total number of players, or the rate of play, and the anticipated time until a progressive pool award associated with a less-frequently occurring or unique winning number is won to determine if and when such supplemental winning numbers should be generated, for example to further stimulate player interest and participation. These supplemental game segments are within and a part of the overall game, which continues unabated.

Bonus features may be limited to an individual game terminal 102 or to any subset of game terminals 102 or to all of the game terminals 102 networked to the central controller 104. These additional bonus feature opportunities may be displayed on the game terminal's data display 132. The data display 132 provides notification to the player of the existence of the bonus feature and provides another numerical "target" for the player to try to "hit". The bonus feature may simply comprise providing another winning number for the player to try to hit, or provide combinations of numbers within, for example, an issued numbers that provide winning outcomes. For example any number with the integer "7", such as 1007003 may be a potential bonus feature winning outcome, a greater number of 7's providing a higher award and adjacent 7's even a higher award. Because the number of different bonus features which may be associated with the game is potentially unlimited, the game may be continually modified over time, presenting an ever-changing challenge to its players.

Another variation to the game of the present invention provides a player with an opportunity to make multiple bets in the form of requesting multiple numbers with a single activation of the input element or actuator 30. This may be allowed when the player makes a wager sufficient to support multiple number requests at game terminal 102. For example and illustrative of a convenient manner in which multiple numbers may be requested, a player may place twenty dollars in the wager acceptor 134 of a game terminal 102 whereon the smallest permissible wager is one dollar, the monetary input being reflected in a credit meter associated with the wager acceptor. The player may elect to bet one dollar at a time and request a single number for each activation of input element or actuator 130, the credit meter then being debited by one dollar. Alternatively, the player may elect, for example, to request five numbers at a time, so that activation of input element or actuator 130 will result in a request for and issuance of five running count numbers associated with the moment in time of the request at game terminal 102, and the credit meter will be debited five dollars. The five numbers may be in direct incremental sequence, such as 10, 11, 12, 13 and 14, or input element or actuator 130 may have different modes such as, for example, a "delay" mode which results in five individual requests for numbers being sent at one tenth second intervals, so that other intervening requests by players at other game terminals 102 may intervene and the numbers issued responsive to the five requests may thus be non-consecutive. Of course, a large wager may be made to secure a single number, with an appropriately larger award if the single number is a winning number.

A request for multiple running numbers in a "batch" mode to secure sequential numbers may be easily accomplished by having the logic circuit 138 of a game terminal 102 include a code in the request record transmitted to the central controller 104 to indicate the number of running count numbers to be assigned. The running count numbers provided are preferably in time order, and provide the player with the opportunity to achieve greater odds of success, particular when issuance of a winning number is recognized to be imminent. The individual numbers of the group of running count numbers may be printed on individual tickets or, preferably, on a single ticket or only the low and high numbers of the group may be printed. Alternately, the request may be encoded to provide a plurality of tickets having randomly-issued numbers. Thus, another form of strategy may be employed by a player using single unit bets to develop an information framework around which subsequent multiple bets or groups of multiple bets may be made once the player has pinpointed a target time zone where a winning number, such as a less frequently repeated number or a unique, high award number, is likely to occur.

The ability to have multiple running count numbers assigned improves the game's playability by allowing the player not only to develop a strategy based on timing, but also a strategy related to the amount of the wager other than merely placing a larger bet. In addition, it is believed that the present invention will attract a broad spectrum of players. Many sophisticated gamblers only want to play with relatively larger sums; whereas less experienced gamblers prefer smaller denominations. Consequently, the flexibility offered by the flexible betting regime of the present invention allows it to attract players across the entire spectrum.

The present invention may be set up to include a progressive type gaming aspect wherein a portion of each wager is allocated to one or more higher awards for less frequently repeated, or unique winning numbers, or to fund jackpots awarded for play of another game entirely. Alternately, the present invention may be set up with payout tables setting out a specific, set award amount that can be won for matching each specific winning number. A hybrid game may also be established that allows, for example, a large jackpot to be a progressively funded and other prize winning criteria can be associated with payout tables having specific, fixed awards. In the embodiment described below wherein attempting to hit a target time instead of matching a winning number is the goal and thus some awards may be missed entirely, missed lower tier fixed prizes may be rolled over into the progressive. A pari-mutual award format is also contemplated.

In the case of a hybrid fixed/progressive game approach, the central controller 104 may be programmed to receive and store wager information as it is transmitted from the game terminals 102. In addition to tracking the wagers made, the central controller 104 is also programmed with fixed award amounts for some winning numbers such as those periodically occurring, as well as a percent of contribution from each wager which is diverted to a progressive prize pool reserve for funding large jackpots or other bonus feature winning number awards and reducing the reserve as these awards are won. For example, entry into the game of the present invention may, in addition to the "instant win" of the game itself, be used to fund a jackpot based on another type of lottery or other game of chance, the tickets issued by game terminals 102 thus comprising entries to the other game which are assigned unique numbers associated with the other game, such as a periodic drawing. Central controller 104 may also be programmed to initiate differently sized bonus feature awards, selecting from a range of potential values available given frequency and amount of wagers placed over a given period of time. Any or all of this information may be communicated to the game terminals 102 for display on data display 132.

The payout for bonus features may come from additional reserve pools that are maintained by the central controller 104 based on a programmed apportionment scheme. The central controller 104 may be programmed to initiate bonus features, select associated winning criteria, and allocate funds from wagers to a reserve pool for paying off the winners of such features.

In the event that no interim bonus features are needed to generate or maintain enthusiasm for the game, the bonus reserve pools may be used to find runner up winners. For example if the a grand award goes to number 777777, a second place award for the number 777776 and a third place award for the number 7777778 may be funded from the reserve pool. To further amplify the foregoing, an ultimate goal of the game is to activate input element or actuator 130 at the exact point in time that a number issued in response thereto matches the target winning number.

Alternately, the reserve pool may be allocated at any point in time to establish a super jackpot to be paid, for example, to the hundredth occurrence of a winning number within a 24 hour period. This provides another element of excitement as a player's potential stakes in the game and desire to win are suddenly magnified by the sudden increase in the jackpot.

If supplemental game segments or bonus features are incorporated in the architecture of a game according to the present invention, it is also contemplated that enabling play of such supplemental segments or bonus features may be in the form of a "comp" tied to, for example, frequent plays of the primary form of the game, frequent wins at the primary form of the game, or both. Thus, a more dynamic award structure may be made available in real time for a consistent player of the game, with players who play the primary form of the game more and/or generate more winnings therefrom being rewarded accordingly.

As noted above, the processor of the central controller 104 may also determine when an assigned number is a winning number, or be preprogrammed with a set of winning numbers or an algorithm to recognize same. Thus, the central processor "knows" the winning numbers, compares each assigned number to the suite of winning numbers, and substantially instantaneously determines whether or not the assigned number matches a winning number and the player is a winner. If the assigned number is a winner, a response signal is generated that contains not only the assigned number, the winning number and the game terminal identifier, but also a payout amount and even a payout notification code. This payout notification code contains the amount won and an enabling code for game terminal to activate data display 132 and, optionally, audio and/or visual "winner" indicators such as horns, bells, sirens, flashing lights, etc. When the game terminal's logic circuit 138 receives the payout notification code, responsive to suitable preprogramming it enables the data display 132 to display the win to the player and activates the winner indicators of the game terminal.

Monetary payouts from the game may be issued in a number of ways well known in the art. Such methods include direct payout of coinage (such being easily effected in a casino environment), payouts from an attendant responsive to tendering a winning ticket, or by crediting a player identification card, a gaming card which may be charged with funds for betting and debited and credited during play, or to a bank debit card or the like. Although it is possible to wager with coinage and bills and received currency payouts, such an approach being easily effected in a retail environment. such as a convenience store having an attendant-served game terminal, in some environments it may be preferred that credit/debit/cash cards be employed, particularly if rapid betting and multiple bets to secure groups of numbers are to be facilitated. The advantage of these types of cards is that they allow instantaneous wagering and facilitate timing of wagering without the need to feed additional coins to the game terminal. In a hotly contested game where speed and timing of wagering may become an important factor for winning, the inability to immediately generate a request record and send a request signal may place a player at a disadvantage. With the placement of a card in the machine the player can pay full attention to the progress of the game and immediately request numbers at times of his or her choice without the hindrance of feeding the game terminal with additional currency.

Figure 3A:
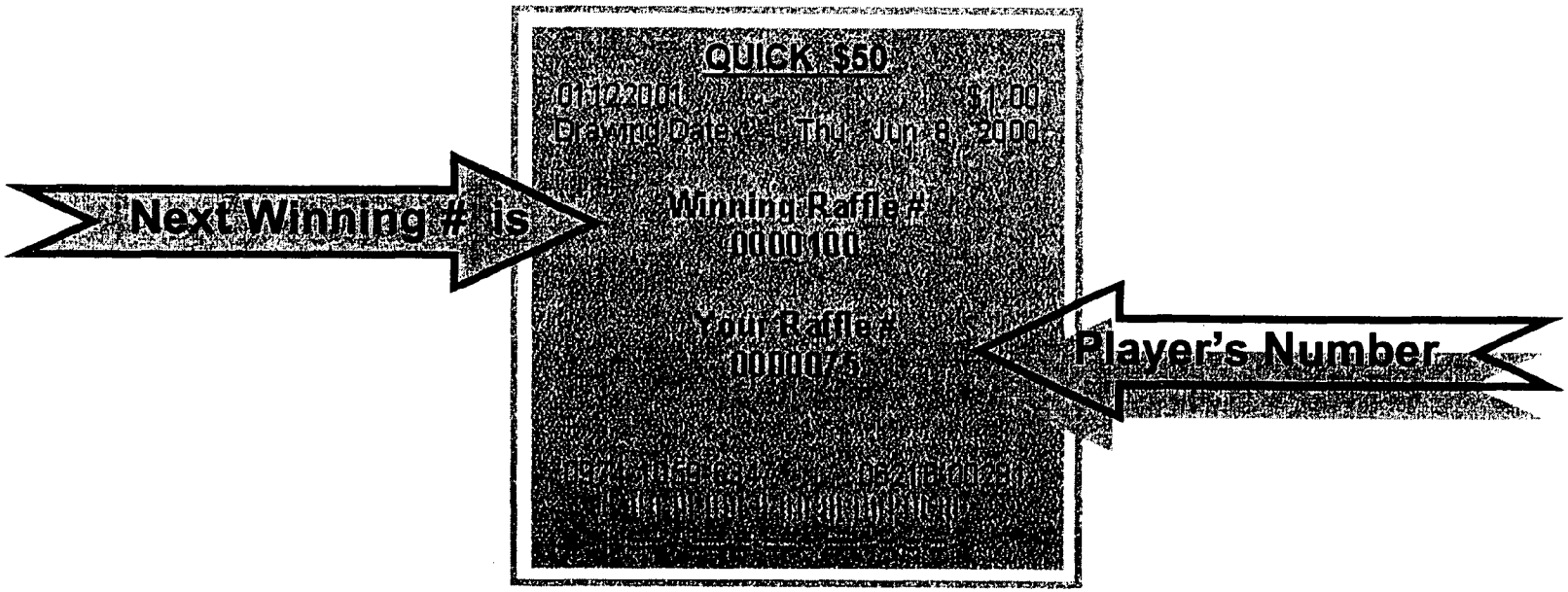
FIG. 3A is an enlarged illustration of an exemplary ticket issued by a game terminal in gaming according to one embodiment of the present invention.
Figure 3B:
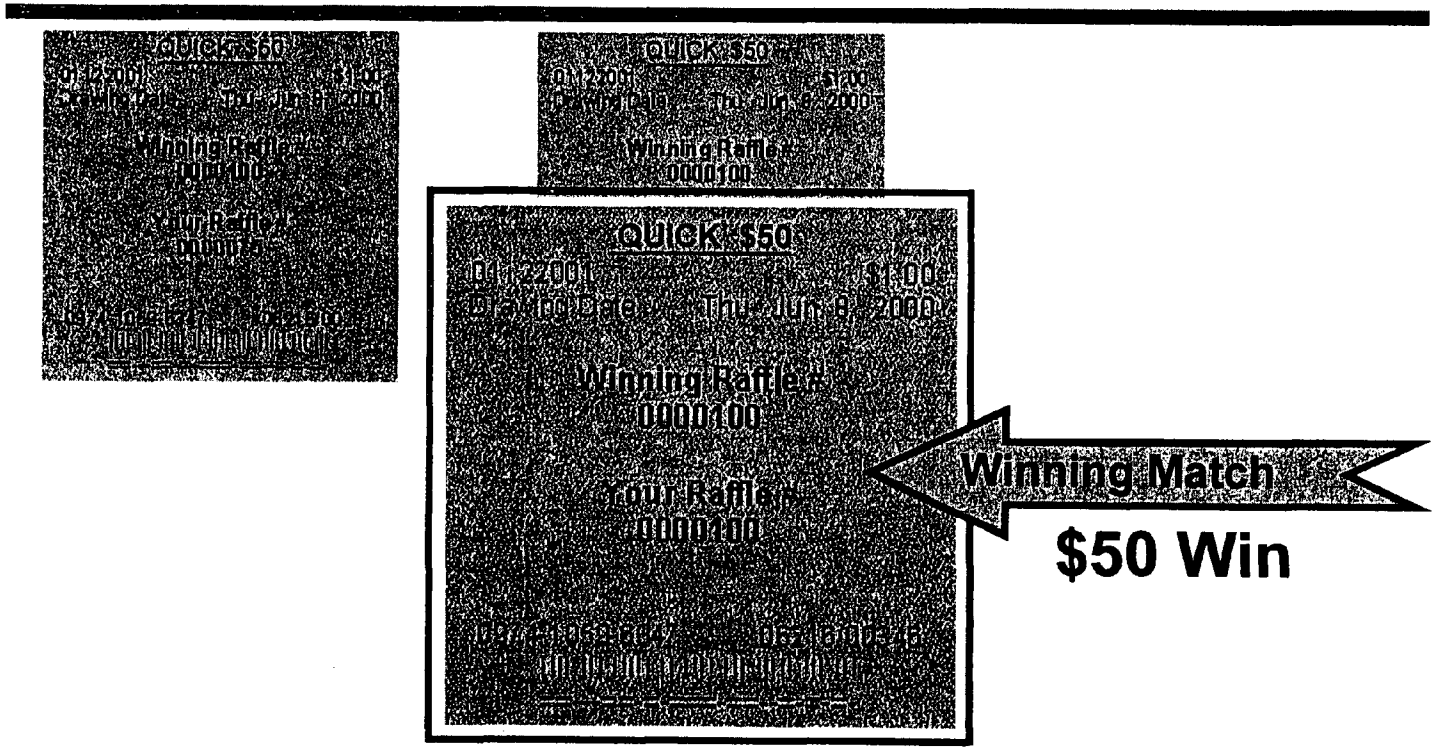
FIG. 3B is an enlarged illustration of an exemplary winning ticket for that embodiment with the exemplary, non-winning ticket of FIG. 3 in the background.
Figure 1:
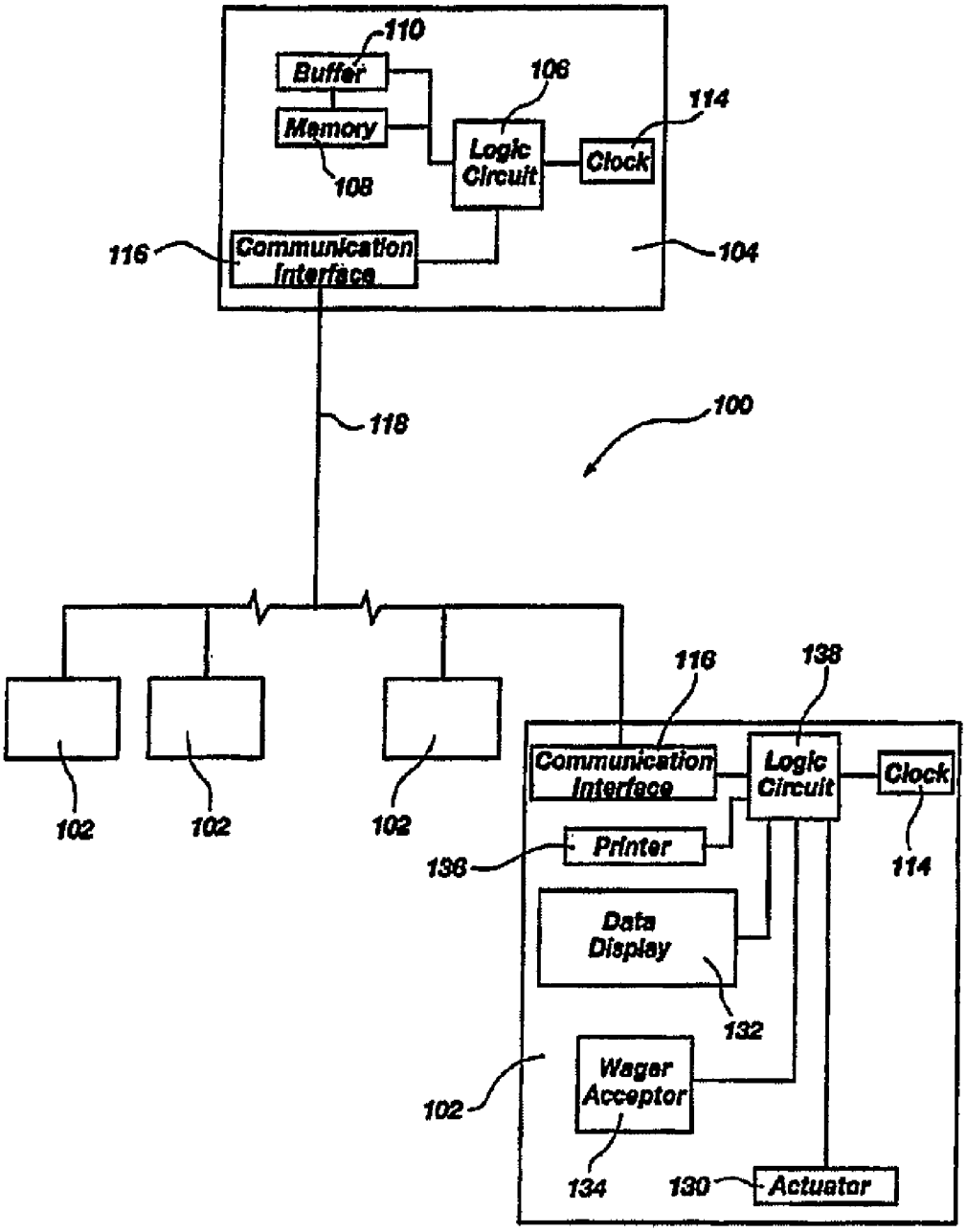
Figure 2:
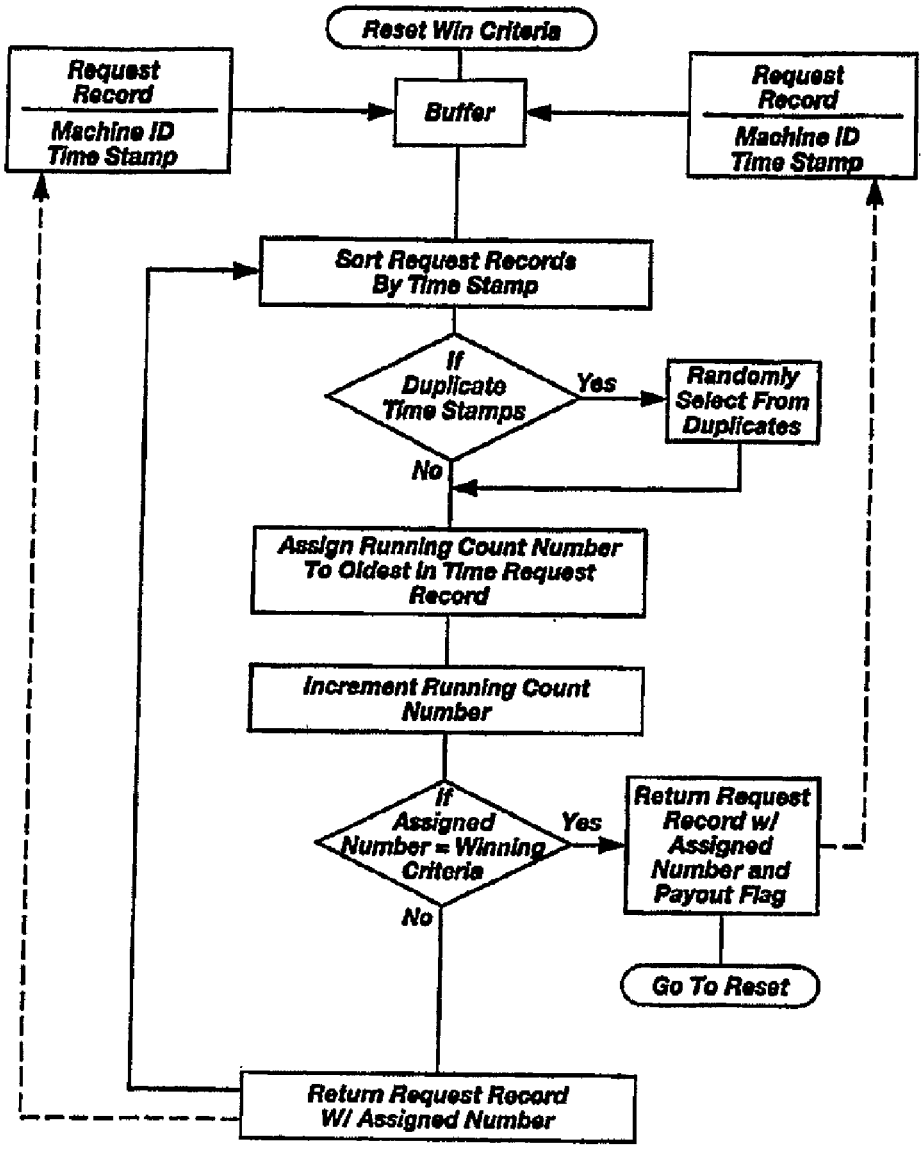
Figure 3A:
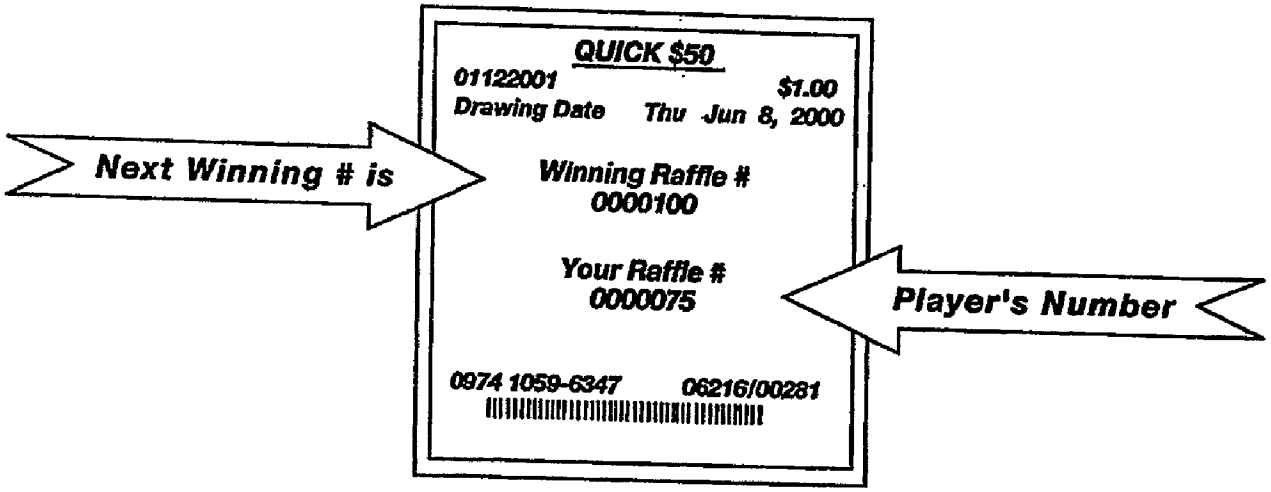
Figure 3B:
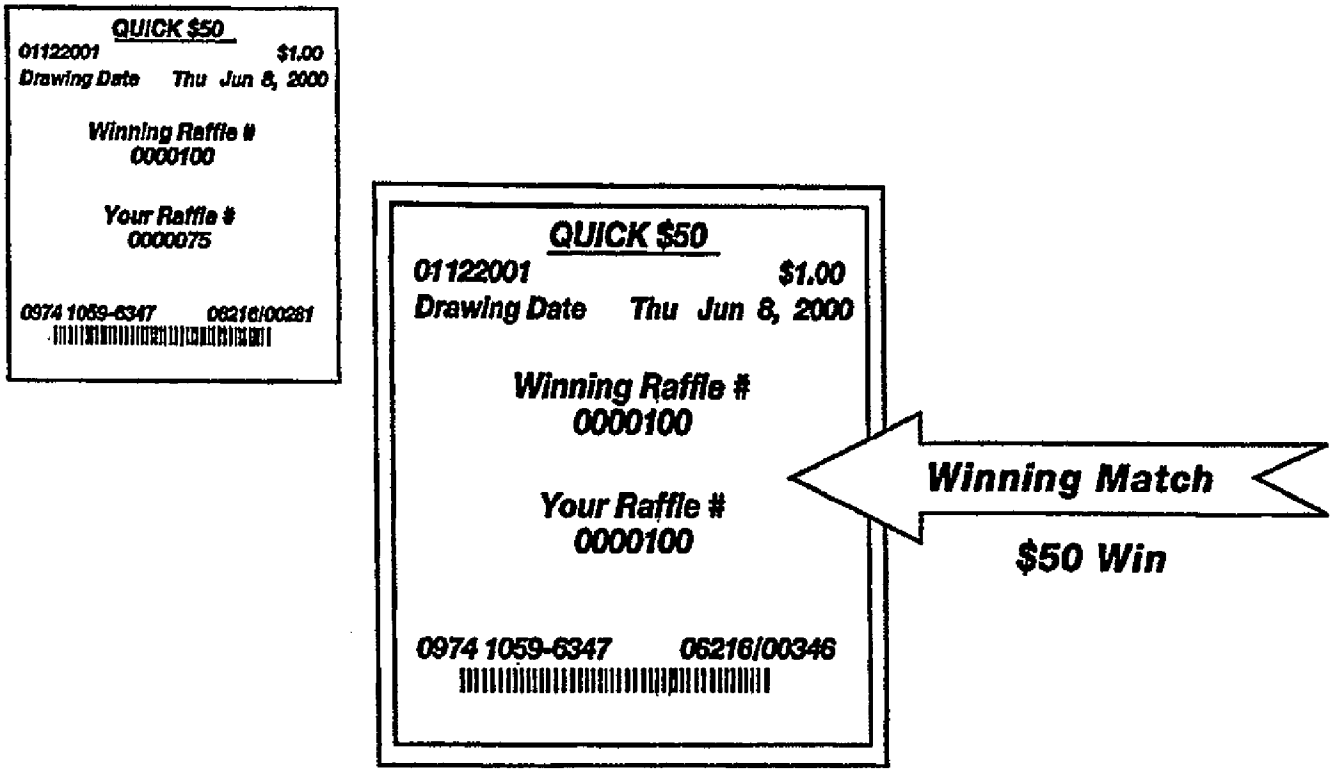

In some embodiments contemplated for this invention, in particular for lottery systems, an attendant at a retail location such as a convenience store is generally charged with running the on-site game terminal. In these types of games, the wagering and any payout activities are carried out through the attendant. The wager is made and the player receives a hard copy data display. Rather than receiving a payout from the game terminal, the hard copy data display is submitted to the attendant or other appropriate authority (such as in the case of a large award) to claim the payout. The hard copy data display may be encoded with the appropriate security markings and validation and verification numbers to ensure the security of the system. Such data may, of course, be encoded in the response signal. An enlarged illustration of an exemplary ticket issued by a game terminal in play of the running count number embodiment of the present invention, such as might be implemented in a lottery environment, is depicted in FIG. 3A, while an enlarged illustration of an exemplary winning ticket is illustrated in FIG. 3B, the ticket of FIG. 3A being in the background for comparison purposes. It may be desirable in some retail environments to arrange the issued number and winning number or numbers in different sequences so as to prevent a retail clerk or other game terminal attendant from recognizing and pocketing winning tickets when a large group of tickets are being issued. For example, the sequences may comprise, with the integer order indicated by the first number of each pair and the actual winning number and assigned number indicated by the second number of the pair:

Predetermined Winning Number:

| | | | | | | |
|---|---|---|---|---|---|---|
| 1) 0 | 2) 0 | 3) 0 | 4) 0 | 5) 1 | 6) 0 | 7) 0 |

Player's Number (also a winner in this place):

| | | | | | | |
|---|---|---|---|---|---|---|
| 4) 0 | 1) 0 | 7) 0 | 5) 1 | 2) 0 | 6) 0 | 3) 0 |

As an alternative approach to issuing "numbers" per se which may be matched with one or more winning numbers, it is contemplated in another embodiment of the invention that increments in the passage of time itself may be used as a series of numbers, so that a winning number is actually a moment in time rather than an issued number and matching a number with a winning number comprises matching a time of a signal initiated at a game terminal with a winning target time. With such an approach, a signal from a game terminal representative of a moment in time and comprising a "time entry" may be sent to the central controller which, if the time entry matches the winning target hit time, a winner has been determined. The central controller then messages the game terminal that a match, and a win, has occurred. Alternatively, the central controller may send out one or more target hit times which are "claimed" by a game terminal if timing of a time entry signal initiated at that game terminal matches the target hit time.

If a time target is used as a winning number, timer resolution may, of course, become an issue, as closeness of a match is significant and determination of how close a match is between a player's hit time and a target hit time is a function in part of timer resolution. If a high resolution timer is employed, e.g., microseconds, looking for an exact match may not provide acceptable game parameters. To resolve this, time resolution may be reduced or the values used to determine a match may be rounded off. Alternatively, a time "window" may be used to implement a winning match, where the winning time window includes a range higher and lower than the precise "exact" time within which a win may be captured. As noted above, high resolution time may be used as a tool to minimize the likelihood of ties or serve as a means to resolve apparent ties.

Thus, a difference in time, either measured in units of time which is close to the target time but not an exact match, may be viewed as a measure of the accuracy of each attempt and used for award purposes. A large award, such as a progressive, may be given for an exact match. Smaller, for example fixed, awards may be given for near misses to an exact match. If the nearness of an attempt is measured in time, awards of, for example, 100 credits may be made for within 10 milliseconds, 25 credits for within 30 milliseconds, and 2 credits for within 100 milliseconds. Since it is entirely possible in a time-driven incrementing embodiment of the game that no exact match or even a near miss resulting in an award will occur, a progressive funding scheme may be used wherein a percentage of each ticket sale or other wager goes into the award pool. If the target is missed, the pool rolls over to the next target.

The "near miss" approach to an award format as described immediately above is also easily implemented in a running count number embodiment of the invention as noted above. By way of an additional example, however, if nearness is measured in proximity of an issued running count number to a winning number, if the issued running count number is within 1 of the winner, 100 credits may be awarded; within 3, 20 credits; and within 10, 3 credits.

While it is contemplated that the numbers issued to a player be displayed to the requesting player immediately after each wager with an associated request for a number, such is not required. It is contemplated that the number may not be displayed at all, or that the running number count be displayed periodically or continuously in addition to or in lieu of each issued number.

It is also contemplated that, in the context of a game having multiple award tiers, the larger award amounts and associated winning numbers or target times may or may not be shown to the players wagering on the game, at least until after each larger award is triggered. Thus, players may know that an award may, for example, be at least $10 if a winning number or target time is hit, but that the award may also be $1,000,000. In such a manner, a player's tendency to only wager to try and hit a larger award may be substantially eliminated.

Yet another approach to the game of the present invention is to enable play of higher award games through winning at lower award games. Stated another way, the game may be implemented with multiple levels of play with progressively higher awards. To participate in each respectively higher level, a player must first win at a lower level. For example, the game may be implemented with a base game segment having a single tier of awards of, for example, $5 for hitting each winning number. In addition to the $5 award, however, a winning player may also receive the right to make five attempts in another game segment that has a single tier of awards at, for example, a $50 level. The higher award game may be run subsequent to or concurrently with the lower award game. Additional award tiers, each higher than the next and requiring qualification through a win at a lower tier game segment, may also be implemented.

It is further contemplated that additional approaches may be employed for incrementing the running number count, including incrementing based on multiple sources of input. For example, in addition to incrementing the running number count responsive to each wager and request for a number, the running number count may include a continuous, periodic increment. Thus, the number count keeps advancing even in the absence of players. The running number count might also be advanced responsive to other inputs, such as for example the number of shares sold on a stock exchange, or the rate of trading on an exchange. Of course, in the situations where multiple sources of input are used, as with a time-based matching scheme, winning values may be easily missed so that a progressive type award arrangement is highly desirable to maintain consistent overall game odds.

An approach to implementing the game of the present invention which is implicit in the foregoing description regarding issuance of random running count numbers is that players' numbers need not be consecutive, at least within a series. For example, if a number series is 001 to 100 and the target (winning number) is 100, the first number issued to a player may be 078 and the second number issued in the series may be 100. The remaining (losing) numbers in this example would then be issued prior to moving on to the next series of 101–200. While taking some element of timing out of the game, such an approach for frequently occurring numbers will have no appreciable effect on game play when a large number of players and game terminals are involved.

When using multiple series of numbers each having a winner therein, again for example a number series of 001 to 100 followed by a number series of 101 to 200, the game may be implemented using a different, such as a randomly generated, number within each series as the winning number for that series. Thus, in the 001 to 100 number series, the winning number may be 012, while in the 101 to 200 number series, the winning number may be 198. Such an approach provides the same payout ratios as an approach wherein the numbers 100 and 200 are the winning numbers, but randomizes the game if a timing element is not perceived as being a significant benefit.

While disclosed as a base or primary game, it is also contemplated that the present invention may be implemented as a bonus game associated with a base or primary game, particularly in a casino environment where secondary or bonus games are well-received by players. In so doing, and by way of example, a player may win points in the primary game, the points being representative of a number of actuator hits in a bonus round comprising the game of the present invention. Alternatively or in addition, certain specific outcomes in the primary game may be used to initiate an automatic request in the bonus game of the present invention.

In addition to the foregoing alternatives, one might implement the game of the present invention so that players may pick the actual time the running count number in that embodiment of the invention will reach a specific target value. This approach may be in addition to or in lieu of requesting running count numbers. In addition, another aspect may be to implement the game so that prizes for near miss guesses as to the time the final winning number occurs will be greater for the guesses made farther in advance of the time the final winning number occurs. For each potential award of that sort, the magnitude of the prize or the time window within which a guess must fall may be reduced as the end draws closer.

The game of the present invention provides numerous advantages in comparison to the state of the art, with respect to both the game operator and players. For example, the game is a unique "niche," instant win game which may be easily added to gaming in a casino or lottery environment and is particularly attractive to leverage an existing lottery network already including game terminals for other games. Further, the game exhibits a perpetual, self-funding prize structure as the game progresses, and profitability is optimized and predictable as the exact percentage of wagers to be issued as winnings may be preset. In addition, there is a minimal additional investment by the game operator, as the present invention is point of sale driven and requires no play slip, drawing or associated promotion. The game will enable widespread participation, and is not required to be targeted at a particular population segment. The timing feature of the game provides an entertainment, "gun for win" factor which is absent from most games of chance.

Further, for game operators, the game is "no risk" as compared to instant win tickets, conventional pool games and fixed "xyz" payout tiers, as the operator knows the identity and frequency of occurrence of the winning numbers, and the awards associated therewith. In comparison, in most lottery type games, the house (lottery operator) is always at risk. For example, with instant win tickets, a game may not sell out, causing more prizes to be paid than tickets sold, especially if the top prize is cashed early in the game. With lotto-type games, fixed top tier prizes and/or fixed lower tier prizes often diminish profits from the game. With pool-type games (such as picking three of four numbers), if a popular number such as 111 hits, the operator may face a huge loss. In addition, the manner in which awards may be made, such as for example awarding $50 on a $1 wager to each hundredth number and thus a 50% payout with some degree of predictability, is attractive to players who may wager in the hope of getting a real and significant return. Of course, additional, higher award tiers as previously described may be structured for a higher overall payout which is offset by increased attractiveness of the game due to the available, higher awards in addition to the basic (for example, every hundredth number) awards.

The present invention, while described in the context of certain exemplary embodiments is not so limited, and those of ordinary skill in the art will readily understand and appreciate that additions and modifications to as well as deletions from the disclosed embodiments may be made without departing from the scope of the invention. Similarly, features from different embodiments may be combined while remaining within the scope of the invention.

What is claimed is:

1. A method of playing a game of chance having a plurality of players, comprising the steps of:

selecting at least one winning number according to a predefined criterion known to players of the game, the predefined criterion based upon a specific sequential number of selection, and the at least one winning number having an award associated therewith;

providing an opportunity for each of a plurality of players to request at least one number from a series of numbers including the at least one winning number, wherein each request by a player affects winning odds of the plurality of players;

issuing at least one number to each player in substantially an order of request time, each of the at least one number issued being different from any other number issued; and paying the award to a player with a number which matches the at least one winning number.

2. The method of claim 1, further comprising the step of selecting the series of numbers, wherein each number differs by a fixed value from a next preceding issued number in the series.

3. The method of claim 2, wherein each number differs from the next preceding issued number in the series by a fixed value of one.

4. The method of claim 1, wherein each issued number is greater than a next preceding issued number.

5. The method of claim 1, wherein each issued number is lesser than a next preceding issued number.

6. The method of claim 1, further comprising the step of enabling each player to wager a monetary sum to initiate the request for the at least one number.

7. The method of claim 6, further comprising the step of enabling each player to wager different monetary sums to initiate the request for the at least one number.

8. The method of claim 6, further comprising the step of enabling each player to wager a multiple of a unit monetary sum and request a plurality of numbers from the series.

9. The method of claim 8, further comprising the step of enabling each player to request a plurality of consecutive numbers from the series of numbers responsive to wagering the multiple of the unit monetary sum.

10. The method of claim 8, further comprising the step of enabling each player to request a plurality of nonconsecutive numbers from the series responsive to wagering the multiple of the unit monetary sum.

11. The method of claim 10, wherein the plurality of nonconsecutive numbers comprises numbers randomly selected from the series.

12. The method of claim 1, wherein the at least one winning number comprises a plurality of winning numbers, and further comprising the step of selecting winning numbers to occur at intervals in the series.

13. The method of claim 12, further comprising the step of associating an award of equal value with each of the winning numbers.

14. The method of claim 12, further comprising the step of associating awards of differing value with at least some of the winning numbers.

15. The method of claim 14, further comprising the step of selecting magnitudes of the awards of differing value according to a multitiered scheme, wherein the winning numbers of a category occurring in the series more frequently have awards of lesser value associated therewith.

16. The method of claim 15, further comprising the step of selecting the magnitudes of the awards of differing values in relation to a frequency of occurrence in the series of the winning numbers of a respective category.

17. The method of claim 16, further comprising the step of selecting an award magnitude greater than any other award magnitude associated with a winning number for a winning number occurring only once in the series.

18. The method of claim 12, further comprising the step of selecting the intervals to be regular intervals.

19. The method of claim 1, further comprising the step of administering the game of chance over a distributed network that includes a plurality of game terminals, each game terminal having a communication link associable therewith.

20. The method of claim 19, further comprising the step of enabling each player to play the game of chance via personal access to a game terminal.

21. The method of claim 19, further comprising the step of enabling each player to play the game of chance at a game terminal accessed by another person on the player's behalf.

22. The method of claim 19, wherein an order request time is determined as the time of placement of a request for a number at a game terminal.

23. The method of claim 19, wherein the distributed network further comprising a remote central controller accessible by each game terminal via the communication link associable therewith, and further comprising the steps of making requests for numbers at game terminals, transmitting the requests for numbers from the game terminals to the remote central controller and issuing numbers from the remote central controller responsive to the requests received thereat.

24. The method of claim 23, wherein an order request time is determined as the time of placement of a request for a number at a game terminal.

25. The method of claim 23, further comprising the step of generating at a game terminal at which a request was made at least one tangible manifestation of the request time, the at least one issued number associated with the request time and the at least one winning number responsive to each made request transmitted by the game terminal at which that request was made.

26. A gaming system, comprising:

a plurality of game terminals; and a central controller accessible by each of the game terminals via a communication link associated therewith, the central controller including a winning criterion known to players of the game, the predefined criterion based upon a specific sequential number of selection;

wherein each game terminal includes:

a device for recording a player wager;

an actuator and circuitry responsive to recordation of a player wager for making a request for at least one number of a series of number in association with the recorded player wager and a moment in time and transmitting the request to the central controller via the associated communication link; and wherein the central controller includes a circuitry for receiving requests for numbers via the communication links from each of the game terminals, comparing the received requests as to order of request time, issuing at least one number from a series of numbers responsive to each received request in an order based on a time associated with each of the requests, each received request affecting winning odds of other received requests, comparing the at least one issued number to at least one winning number in the series having a monetary award associated therewith, the at least one winning number selected according to the winning criterion and transmitting the at least one issued number via the communication link back to a game terminal from which a request associated with the at least one issued number was received, each at least one issued number differing from any other issued number.

27. The gaming system of claim 26, wherein each game terminal includes a device for generating a tangible manifestation of a player wager, the request time associated with the player wager, the at least one issued number and the at least one winning number responsive to receipt of a communication from the central controller including the at least one issued number.

28. The gaming system of claim 26, wherein each game terminal includes a data display associated therewith for display of information.

29. The gaming system of claim 26, wherein each game terminal is configured for acceptance of wagers and making requests for numbers directly from players.

30. The gaming system of claim 26, wherein each game terminal is configured for recordation of wagers accepted from the players by another person and making requests for numbers by the another person.

31. The gaming system of claim 26, wherein the central controller includes a logic circuit for generating numbers of the series.

32. The gaming system of claim 31, wherein the logic circuit is programmed to issue the numbers from the series, each issued number differing from every other issued number.

33. The gaming system of claim 32, wherein the logic circuit is programmed to issue the numbers from the series mutually differing by a fixed value.

34. The gaming system of claim 33, wherein the fixed value is one.

35. The gaming system of claim 26, wherein the central controller includes a second circuitry for compiling requests in the order of request time in order to effect comparison thereof as to the order of request time.

36. The gaming system of claim 26, wherein the central controller further includes a clock for determining a time order of request times received.

37. The gaming system of claim 36, wherein each game terminal includes a clock for associating each request made at the respective game terminal with a moment in time.

38. The gaming system of claim 37, further including circuitry of the central controller and circuitry of each of the game terminals for maintaining the clock of the central controller and the clocks of the game terminals in substantial synchronicity.

39. The gaming system of claim 38, wherein the circuitry of the central controller and the circuitry of the game terminals for maintaining the central controller and game terminal clocks in substantial synchronicity is responsive to communications between the central controller and each of the game terminals.

40. The gaming system of claim 38, wherein the request times employed in comparing the received requests are times of requests at the game terminals.

41. The gaming system of claim 26, wherein the at least one winning number includes a plurality of winning numbers and the central controller includes a circuitry for associating monetary award amounts with the at least one winning number.

42. The gaming system of claim 41, wherein the monetary award amounts include at least some differing award amounts.

43. The gaming system of claim 42, wherein the differing monetary award amounts are related to a relative frequency of occurrence of the at least one winning number associated therewith.

44. The gaming system of claim 26, further comprising a circuitry at each of the game terminals configured for enabling each player to wager different monetary sums.

45. The gaming system of claim 44, further comprising a circuitry at each of the game terminals configured for enabling each player to wager a multiple of a unit monetary sum and request a plurality of numbers from the series.

46. The gaming system of claim 45, wherein the plurality of numbers comprise consecutive numbers from the series.

47. The gaming system of claim 45, wherein the plurality of numbers comprise nonconsecutive numbers from the series.

48. The gaming system of claim 47, wherein the nonconsecutive numbers comprise numbers randomly selected from the series.

49. A method of playing a game of chance, comprising the steps of:

selecting at least one target time to occur in a future segment of the game of chance and having an award associated therewith;

providing an opportunity for each of a plurality of players to place at least one time entry in a range in time including the at least one target time, each time entry of the at least one time entry having a value of the actual time it is placed, wherein the at least one target time is selected before the plurality of players placing placing their respective at least one time entry; and making the award to a player who placed a time entry from the range of time which matches the at least one target time.

50. The method of claim 49, wherein a match is defined when time entry is within a range of time values selected to encompass the at least one target time.

51. The method of claim 49, further comprising the step of enabling each player to make a wager to place the at least one time entry.

52. The method of claim 51, further comprising the steps of:

allocating a portion of each wager to an award pool, paying the portion of each wager accumulated as the award if a match of the time entry to the at least one target time occurs and, if no match occurs, continuing to accumulate wager portions to be added to already-accumulated wager portions to pay as the award for a time entry matched to another target time later in time.

53. The method of claim 49, further comprising the step of administering the game of chance over a distributed network that includes a plurality of game terminals, each game terminal of the plurality having a communication link associable therewith.

54. The method of claim 53, further comprising the step of enabling each player to play the game via personal access to a game terminal.

55. The method of claim 53, further comprising a remote central controller accessible by each game terminal via the communication link associable therewith, and further comprising the steps of:

placing time entries at game terminals, transmitting the placed time entries from game terminals to the remote central controller and comparing the placed time entries with the at least one target time at the remote central controller.

56. The method of claim 53, further comprising the step of generating at a game terminal at which the time entry is placed at least one tangible manifestation of the request time, the at least one time entry and the at least one target time responsive to each time entry placed transmitted by the game terminal at which that time entry was placed.

57. A gaming system, comprising:

a plurality of game terminals; and a central controller accessible by each of the game terminals of the plurality via a communication link associated therewith;

wherein each game terminal includes:

a device for recording a player wager;

an actuator and circuitry responsive to recordation of the player wager for placing a time entry in association with the recorded player wager and a moment in time and transmitting the placed time entry to the central controller via the associated communication link; and wherein the central controller include a circuitry for receiving time entries via the communication links from game terminals of the plurality and comparing the time entries to at least one target time having a monetary award associated therewith.

58. The gaming system of claim 57, wherein each game terminal includes a device for generating a tangible manifestation of the wager, the time entry associated with the wager and the at least one target time.

59. The gaming system of claim 57, wherein each game terminal of the plurality includes a data display associated therewith for display of information.

60. The gaming system of claim 57, wherein each game terminal is configured for acceptance of wagers and making requests for numbers directly from players.

61. The gaming system of claim 57, wherein each game terminal includes a clock for associating each time entry placed at a respective game terminal with the moment in time such time entry was placed.

62. The gaming system of claim 57, wherein the central controller includes a clock, and further including circuitry of the central controller and circuitry of each of the game terminals for maintaining a clock of the central controller and the clocks of the game terminals in substantial synchronicity.

63. The gaming system of claim 62, wherein the circuitry of the central controller and the circuitry of the game terminals for maintaining the central controller and the game terminal clocks in substantial synchronicity is responsive to communications between the central controller and each of the game terminals.

64. The gaming system of claim 57, wherein the central controller includes a circuitry for associating monetary award amounts with the target times.

65. The gaming system of claim 64, wherein the monetary award amounts include at least some differing award amounts.

66. The gaming system of claim 65, wherein the differing monetary award amounts are related to a relative frequency of occurrence of target times associated therewith.

67. The gaming system of claim 57, further each game terminal further including a circuitry configured for enabling each player to wager different monetary sums.

68. The gaming system of claim 67, further each game terminal further including a circuitry configured for enabling each player to wager a multiple of a unit monetary sum and place a plurality of time entries.

* * * * *

UNITED STATES PATENT AND TRADEMARK OFFICE

CERTIFICATE OF CORRECTION

PATENT NO. : 7,018,292 B2
APPLICATION NO. : 10/619812
DATED : March 28, 2006
INVENTOR(S) : Tracy et al.

It is certified that error appears in the above-identified patent and that said Letters Patent is hereby corrected as shown below:

The title page showing the illustrative figure should be deleted to be replaced with the attached title page.

The drawing sheets, 1-4 consisting of Figs. 1-3B, should be deleted to be replaced with drawing sheets, consisting of Figs. 1-3B, as shown on the attached page.

Signed and Sealed this

Twentieth Day of February, 2007

JON W. DUDAS
*Director of the United States Patent and Trademark Office*

(12) United States Patent
Tracy et al.

(10) Patent No.: US 7,018,292 B2
(45) Date of Patent: Mar. 28, 2006

(54) METHODS AND SYSTEMS FOR METERED RAFFLE-STYLE GAMING

(75) Inventors: Joseph J. Tracy, Westminster, MD (US); Jason E. Bliss, Odenton, MD (US); Alvin R. Ringgold, Jr., Baltimore, MD (US); Mark G. Meyer, Zionsville, IN (US); Lee E. Cannon, Bozeman, MT (US)

(73) Assignee: Scientific Games Royalty Corporation, Newark, DE (US)

( * ) Notice: Subject to any disclaimer, the term of this patent is extended or adjusted under 35 U.S.C. 154(b) by 0 days.

(21) Appl. No.: 10/619,812

(22) Filed: Jul. 15, 2003

(65) Prior Publication Data

US 2004/0014515 A1 Jan. 22, 2004

Related U.S. Application Data

(63) Continuation of application No. 09/866,389, filed on May 25, 2001, now abandoned.

(51) Int. Cl.
*A63F 9/24* (2006.01)

(52) U.S. Cl. ..... 463/17; 273/269

(58) Field of Classification Search ..... 463/16–22, 463/40–42; 273/138.1, 139, 138.2, 143 R, 273/269

See application file for complete search history.

(56) References Cited

U.S. PATENT DOCUMENTS 4,191,376 A 3/1980 Goldman et al. ..... 273/139
4,306,920 A 8/1980 Weatherford et al.
4,494,197 A 1/1985 Troy et al.
4,665,502 A 5/1987 Kreisner
4,689,742 A 8/1987 Troy et al.
4,817,951 A 4/1989 Crouch et al.
4,922,522 A 5/1990 Scanlon
4,996,705 A 2/1991 Entenmann et al.
5,112,050 A 5/1992 Koza et al.
5,119,295 A 6/1992 Kapur
5,282,620 A 2/1994 Keenen
5,344,144 A 9/1994 Canna
5,536,016 A 7/1996 Thompson
5,564,700 A 10/1996 Celona
5,816,920 A 10/1998 Hanai
5,830,067 A 11/1998 Graves et al. ..... 463/40
5,871,398 A 2/1999 Schneier et al.
5,885,158 A 3/1999 Torango et al.
5,970,143 A 10/1999 Schneier et al. ..... 463/29
6,146,272 A 11/2000 Walker et al.
6,168,521 B1 1/2001 Luciano et al.
6,203,430 B1 3/2001 Walker et al.
6,210,275 B1 4/2001 Olsen
6,220,961 B1 4/2001 Keane et al.

OTHER PUBLICATIONS

Judith Gaines, Pool party Betting business booming throughout area workplaces, (Mar. 19, 1994).

*Primary Examiner*—Mark Sager
(74) *Attorney, Agent, or Firm*—Carlton Fields, P.A.

(57) ABSTRACT

Methods and systems for metered, raffle-style gaming implemented over a distributed network of locations and suitable for use in lottery and casino gaming environments. Potential winning numbers are issued in an order determined by relative time of a request for a number as received by a central controller, in comparison to the timing of other requests received by the controller, and matched to one or more known or predictable winning numbers. Time entries placed by players and compared to one or more target times may also be used to determine winning outcomes.

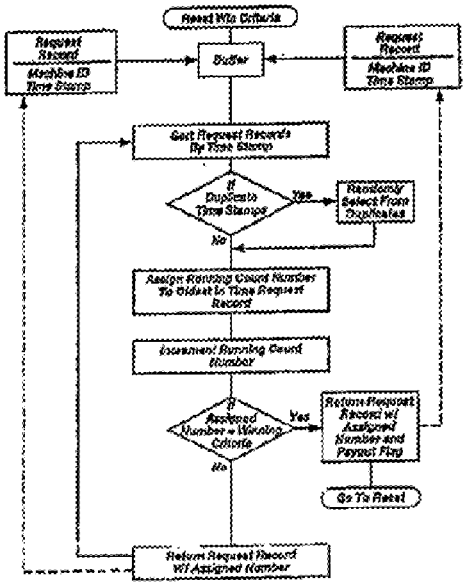

68 Claims, 4 Drawing Sheets